US009683703B2

(12) United States Patent
Peterson

(10) Patent No.: US 9,683,703 B2
(45) Date of Patent: Jun. 20, 2017

(54) METHOD OF STORING AND TRANSPORTING LIGHT GASES

(75) Inventor: Edward R. Peterson, Pearland, TX (US)

(73) Assignee: Charles Edward Matar, Rivervale, NJ (US)

( * ) Notice: Subject to any disclaimer, the term of this patent is extended or adjusted under 35 U.S.C. 154(b) by 1210 days.

(21) Appl. No.: 12/704,372

(22) Filed: Feb. 11, 2010

(65) Prior Publication Data

US 2011/0041518 A1 Feb. 24, 2011

Related U.S. Application Data

(60) Provisional application No. 61/234,908, filed on Aug. 18, 2009, provisional application No. 61/234,900, filed on Aug. 18, 2009.

(51) Int. Cl.
*F17C 11/00* (2006.01)

(52) U.S. Cl.
CPC ..... *F17C 11/007* (2013.01); *F17C 11/00* (2013.01); *F17C 2205/0323* (2013.01); *F17C 2205/0341* (2013.01); *F17C 2221/016* (2013.01); *F17C 2221/03* (2013.01); *F17C 2221/033* (2013.01); *F17C 2223/0161* (2013.01); *F17C 2223/0184* (2013.01); *F17C 2223/033* (2013.01); *F17C 2227/0135* (2013.01); *F17C 2227/0185* (2013.01); *F17C 2227/0341* (2013.01); *F17C 2227/0365* (2013.01); *F17C 2260/056* (2013.01); *F17C 2265/012* (2013.01); *F17C 2265/015* (2013.01); *F17C 2265/025* (2013.01); *F17C 2265/05* (2013.01); *F17C 2270/0105* (2013.01)

(58) Field of Classification Search
CPC ..... F17C 11/002; F17C 11/007; F17C 2265/02; F17C 2265/025
USPC ..... 62/48.2, 54.1, 53.2
See application file for complete search history.

(56) References Cited

U.S. PATENT DOCUMENTS 2,382,117 A * 8/1945 Warrick ..... C07C 15/107 585/315
2,973,085 A * 2/1961 Nissen ..... C10L 3/04 206/0.7

(Continued)

FOREIGN PATENT DOCUMENTS

EP 2131096 A2 12/2009
JP 2001208297 A 8/2001

(Continued)

OTHER PUBLICATIONS

International Application No. PCT/US2010/027169 International Search Report dated May 31, 2010, 9 pages.

(Continued)

*Primary Examiner* — Frantz Jules
*Assistant Examiner* — Brian King

(57) ABSTRACT

A method and system of storing and transporting gases comprising mixing the gases with liquid natural gas to form a mixture. The mixture is a liquid-liquid mixture or slurry, and is stored in vessel configured for maintaining the mixture at a first location. The mixture is transported to a second location for storage in vessel for maintaining the mixture. The mixture is removed from the second location storage vessel for separation and use in additional processes.

15 Claims, 12 Drawing Sheets

(56) References Cited

U.S. PATENT DOCUMENTS

| | | | | |
|---|---|---|---|---|
| 3,068,657 | A * | 12/1962 | Allen | B63B 25/08 62/46.1 |
| 3,333,421 | A * | 8/1967 | Shock | C01B 7/09 405/267 |
| 3,877,240 | A | 4/1975 | Kniel | |
| 4,010,622 | A | 3/1977 | Etter | |
| 5,315,054 | A * | 5/1994 | Teel | C10L 3/12 48/127.3 |
| 6,212,891 | B1 | 4/2001 | Minta | |
| 7,143,606 | B2 | 12/2006 | Tranier | |
| 7,168,265 | B2 | 1/2007 | Briscoe | |
| 7,183,451 | B2 * | 2/2007 | Gattis et al. | 585/324 |
| 7,219,513 | B1 | 5/2007 | Mostafa | |
| 7,240,498 | B1 | 7/2007 | Shivers | |
| 7,594,414 | B2 | 9/2009 | Wilding | |
| 8,028,724 | B2 * | 10/2011 | Lee et al. | 141/11 |
| 2005/0204625 | A1 * | 9/2005 | Briscoe | C10L 3/003 48/127.3 |
| 2006/0042273 | A1 | 3/2006 | Morris | |
| 2006/0283519 | A1 | 12/2006 | Campbell | |
| 2007/0125122 | A1 * | 6/2007 | Mak et al. | 62/620 |
| 2008/0148771 | A1 | 6/2008 | Yengle | |
| 2008/0264100 | A1 | 10/2008 | Mak | |
| 2008/0308175 | A1 | 12/2008 | Lee | |
| 2009/0199591 | A1 * | 8/2009 | Lee et al. | 62/618 |

FOREIGN PATENT DOCUMENTS

| | | | |
|---|---|---|---|
| JP | 2005331040 | A | 12/2005 |
| KR | 1020070085611 | A | 8/2007 |
| KR | 1020090086919 | A | 8/2009 |
| WO | 2009155461 | A1 | 12/2009 |

OTHER PUBLICATIONS

Canadian Office Action dated May 23, 2013 for corresponding Canadian Application No. 2,771,610 (2 pgs.).

Written Opinion dated May 31, 2010 from corresponding International Application No. PCT/US2010027169, 3 pages.

International Preliminary Report on Patentability dated Feb. 21, 2012 from corresponding International Application PCT/US2010027169, 4 pages.

Oldenburg, Curtis., Carbon Dioxide as Cushion Gas for Natural Gas Storage, Energy & Fuels 2003, Issue 17, pp. 240-246, published Dec. 19, 2002.

* cited by examiner

METHOD OF STORING AND TRANSPORTING LIGHT GASES

CROSS-REFERENCE TO RELATED APPLICATIONS

This application claims the benefit under 35 U.S.C. §119 (e) of U.S. Provisional Patent Application No. 61/234,900, filed Aug. 18, 2009, and U.S. Provisional Patent Application No. 61/234,908, filed Aug. 18, 2009, the disclosures of which are hereby incorporated by reference.

STATEMENT REGARDING FEDERALLY SPONSORED RESEARCH OR DEVELOPMENT

Not applicable.

FIELD OF THE INVENTION

The present invention generally relates to storing and transporting light hydrocarbons. More particularly, the present invention relates to utilizing liquefied natural gas for storing and transporting light hydrocarbons.

BACKGROUND

Ethylene or ethene is the simplest alkene with the formula $C_2H_4$. Ethylene is produced by methods including pyrolysis, cracking, partial oxidation of hydrocarbons, steam cracking of ethane, or catalytic cracking of heavy olefins. Ethylene is a widely used as a raw material for producing polyethylene, ethylene glycol, ethylene oxide, ethylene dichloride, vinyl chloride and polyethylene. Alternate uses include, welding gases when combusted, anesthetic agents in an 85% ethylene and 15% oxygen mixture, and fruit ripening agents in commercial ripening processes.

Acetylene or ethyne is the simplest alkyne with the formula $C_2H_2$. Similar to ethylene, acetylene is produced by pyrolysis, partial oxidation of hydrocarbons, cracking heavier hydrocarbons, and hydrolysis of calcium carbide. Acetylene is used in welding when combusted, incorporated into polymers and plastics, converted to acrylic acids and used in chemical synthesis of other materials. Further, acetylene may be converted to ethylene by hydrogenation.

Propylene or propene is an unsaturated organic compound with the chemical formula, $C_3H_6$. Propylene is produced from pyrolysis, as a byproduct of hydrocarbon refining, and the cracking of heavier hydrocarbons. Propylene is a raw material for polymers and plastics, and is converted by various pathways to acetone and phenol. In certain instances, propylene is unstable or highly reactive; particularly, it undergoes addition reactions easily as a gas.

Ethylene, acetylene, and propylene are commercially important light hydrocarbon gases with chemical synthesis applications. Additionally, they are used in liquid hydrocarbon fuel synthesis or as a fuel themselves. However, at standard temperature and pressure (STP) these light hydrocarbons exist as flammable, reactive, colorless gases and therefore are difficult to transport in significant quantities over long distances.

SUMMARY

A system for transporting gases, comprising a first gas stream, a liquid natural gas stream, a mixer vessel in fluid communication with the first gas stream and the liquid natural gas stream, configured to form a mixture and a first storage vessel at a first location and in fluid communication with the mixer vessel.

In certain instances the system further comprises a second storage vessel at a second location, a transport vessel in reversible fluid communication with the first storage vessel and configured to transport the mixture from the first storage vessel to the second storage location, and a separator at the second location configured to separate the first gas stream and the liquid natural gas stream.

BRIEF DESCRIPTION OF THE DRAWINGS

For a more detailed description of the preferred instance of the present invention, reference will now be made to the accompanying drawings, wherein.

DETAILED DESCRIPTION

Figure 1:
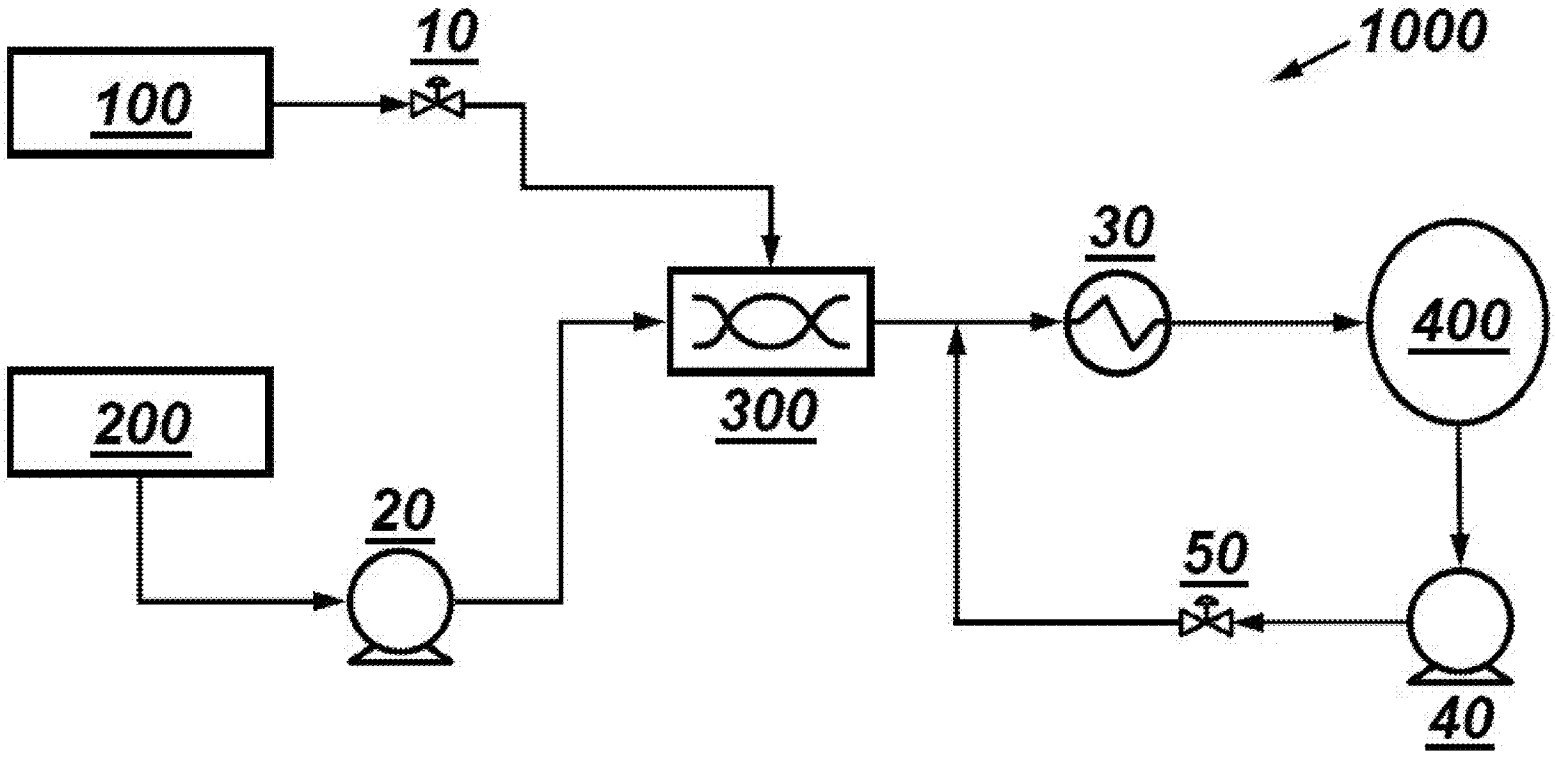
FIG. 1 is a process flow diagram illustrating a light hydrocarbon storage system, according to one embodiment of the disclosure.

Overview: Light hydrocarbon gases, such as acetylene, ethylene, and propylene, are conventionally directed or transported by pressurized or standard temperature pressure (STP) conduits. However, gas conduits can not be used for long distance transportation, for instance overseas, and therefore require that chemical manufacturers and other users are positioned in close proximity to sources of these light hydrocarbons. As such, to store and transport these light hydrocarbons, they are solidified or liquefied by cryogenic processes. Additionally, other gases at STP for commercial or industrial use may be solidified or liquefied for transport. As a liquid or solid, these gases are more readily transported and stored in large quantities when compared to the gaseous phase.

The liquid natural gas (LNG) industry has extensive infrastructure for liquefying natural gas for long distance transport. By introducing the acetylene, ethylene, and propylene, hereinafter light hydrocarbons, to LNG they are condensed, liquefied or solidified, without limitation. The LNG with the light hydrocarbons introduced in this manner form a light hydrocarbon and LNG mixture, herein after HLNG. The HLNG may comprise a liquid-liquid mixture, for instance as ethylene-LNG mixture, or a solid-liquid mixture, such as acetylene-LNG slurry. Without limitation by theory, a liquid or slurry is more readily transported and stored than the gases at STP.

Further, as understood by a skilled artisan, the HLNG may encompass other gaseous compounds that have been condensed for transport. The present process is useful for transporting and storing a plurality of other hydrocarbon and condensable gases with industrial and synthetic applications, hereinafter light gases. Examples of other condensable gases include, without limitation, hydrogen sulfide, ammonia, phosgene, methyl-ethyl ether, tri-fluorobromoethane, chlorotrifluoromethane, chlorodifluoromethane, di-chloromonoflurormethane, and various noble gases. In instances, the condensable gases may be combined with the light hydrocarbons to form light gases. In instances, the light gases are any gases at STP known by a skilled artisan. The light gases introduced to LNG form HLNG for combined transport. Alternatively, the condensable gases may be transported separately from the light hydrocarbons.

Once transported or stored, and in response to commercial need the HLNG is boiled in order to separate and recapture the light gases from the LNG. In certain instances, the HLNG is separated into the light gases and LNG components by distillation. The LNG is boiled off first, for instance for fuel, and the heat of the phase change cools the remaining light gases, maintaining a liquid or solid phase. Further, the refrigeration system may maintain or change temperature, where the boiling point of the LNG is reached before reaching the boiling point of the light hydrocarbons. Thermal energy from any process is introduced to release or boil off the LNG and leave the light gases in a liquid or solid phase. Alternatively, thermal energy from any process is introduced into the HLNG to release or boil off the light gases before the LNG. Further, the light gases and LNG are both vaporized to the gas phase as a gaseous mixture, hereinafter GNG. The GNG is directed to any gas separation processes, such as but not limited to a membrane separator. Alternatively, the GNG is directed to a process for use as a mixture, for instance in gas-to-liquid (GTL) processes.

Storage: Referring now to FIG. 1, a storage system 1000 comprises a light hydrocarbon or other light gas source 100, liquefied natural gas (LNG) source 200, mixing vessel 300, storage vessel 400, valves 10 and 50, pumps 20 and 40, and heat exchanger 30. The light gases are extracted from light gas source 100 via valve 10 and mixed with LNG pumped through pump 20 from LNG source 200 in mixing vessel 300.

In instances, the source 100 is any for providing purified and cooled light hydrocarbons, such as ethylene, acetylene, and propylene. The light hydrocarbons further comprise a portion of other gases, such as carbon dioxide, carbon monoxide, butene, dibutene, vinyl acetylene, methyl acetylene, water, hydrogen, or combinations thereof. In instances, source 100 is pyrolysis, cracking, partial oxidation of heavier hydrocarbons, catalytically cracked heavy olefins, and combinations thereof. For example, an ethylene source may comprise a hydrocarbon source, such as natural gas, naphtha, ethane, propane, butanes, gas oil, fuel oil, vacuum gas residual liquids or non-hydrocarbons such as monoalcohols and diols, in methanol to olefins process or other known processes, without limitation. Additionally, an acetylene source may comprise a hydrocarbon source, such as ethylene, methyl acetylene, propadiene, butadiene, butane, propane, ethane, the pyrolysis of natural gas components, partial oxidation of natural gas components, plasmolysis of natural gas components, and cracking or pyrolysis of hydrocarbons, without limitations. In instances, a propylene source may comprise the gasification of coal, the pyrolysis of natural gas components, partial oxidation of natural gas components, plasmolysis of natural gas components, by products of petroleum distillation, and other known processes without limitation. Any condensable gases at STP, with a boiling point or a freezing point from about 0° C. to about −160° C. may be used in the current process. Other condensable gas sources may be derived from any industrial or commercial chemical process, commodity or specialty chemical processes, including petroleum recovery, petroleum refining, plastics or composites manufacturing, fertilizer manufacturing, and metals production, without limitation.

The natural gas source may comprise methane, ethane, propane, butane, carbon dioxide, outgases from oilfield operations, outgases from coalmining, natural gas wells, or commercially available source. In instances, the NG is converted to LNG by any known processes. In instances, the LNG is produced by reducing the temperature or refrigeration of NG. Alternatively, the LNG is produced by increasing the pressure of the NG. In instances, the LNG may also be commercially purchased from other producers or as a by-product of a known process.

The light hydrocarbon gas is liquefied or solidified when it is mixed with LNG below the normal boiling point temperature of the light hydrocarbon gas at a pressure above the atmospheric pressure. In instances, acetylene is solidified when it is mixed below the triple point, about 192.4 K and 120 kPa, with LNG. Alternatively, ethylene is liquefied when mixed with the LNG at a pressure above atmospheric pressure and below the boiling point of the mixture. The mixing may take place by way of sparging the light gases into the LNG via a sparger or introducing the light gases into the LNG via an injection port. Mixing vessel 300 is any mixer for dispersing light gas into LNG. For example, mixing vessel 300 may be configured as intensive mixers, spargers, paddle mixers, impellers, bubblers, extruders, and combinations thereof, without limitation. Mixing vessel 300 is any vessel configured to maintain temperature and pressure conditions to liquefy or to solidify light gases in LNG. In some cases, mixing vessel 300 is thermally controlled or refrigerated; alternatively, the mixing vessel 300 is insulated. In mixing vessel 300, the light gases dispersed in LNG form HLNG, a liquid-liquid mixture, a solid-liquid mixture or slurry, without limitation.

After HLNG is formed in mixing vessel 300, the HLNG is directed to a storage vessel 400. In certain instances, the HLNG is directed through heat exchanger 30 prior to introduction to storage vessel 400. In instances, the heat exchanger 30 comprises refrigeration cycle to control the temperature of the HLNG. Storage vessel 400 may be any vessel that is capable of providing the proper temperature and pressure for light gas storage in LNG as a solid-liquid or liquid-liquid mixture. In some cases, storage vessel 400 is thermally insulated. Without limitation by theory, mixing the light gases with LNG vaporizes a portion of the natural gas. In instances, the vaporized natural gas cools the surrounding gases by auto-refrigeration. The vaporized natural gas is collected, condensed, and returned to mixing vessel 300 or storage vessel 400; alternatively, the vaporized natural gas is used for fuel or in other processes. In instances, mixing vessel 300 maintains the HLNG as a substantially homogeneous mixture.

Alternatively, additional methods of agitation are used to maintain the homogeneity of the HLNG. Recirculation of the HLNG through the mixing vessel 300 or the heat exchanger 30 agitates and maintains the temperature of the HLNG during storage. The HLNG is extracted from storage vessel 400 by pump 40 and re-circulated to vessel 400 via valve 50 and heat exchanger 30. For example, if the HLNG increases temperature, the refrigeration cycle of heat exchanger 30 reduces the temperature of the HLNG to maintain a predetermined temperature. For example, HLNG is re-circulated under conditions where there is a substantial concentration of solid light gas present in the HLNG. Alternatively, the HLNG is re-circulated when under conditions the HLNG has substantial concentrations of acetylene.

The HLNG solid ethylene concentration is between about 0.1 vol % to about 70 vol % ethylene. Alternatively, the liquid ethylene concentration in the HLNG is from about 0.1 vol % to about 98 vol %; in certain instances, from about 5 vol % to about 95 vol %; and from about 30 vol % to about 90 vol % light gas. The maximum ethylene concentration by volume is determined by the capacity of the liquid phase LNG to mix with and maintain the ethylene in a liquid or solid phase.

In instances, the LNG liquid phase is the continuous phase and the light gas is the dispersible phase. In further instances, the light gas forms a solid phase can be fluidized in the LNG. The HLNG, comprising light gas and LNG is maintained at as a substantially homogeneous mixture. The HLNG maintains a homogenous mixture without further mechanical agitation, regardless of light gas volume concentration. Alternatively, the volume concentration of light gas in HLNG reaches a pre-determined concentration, wherein the HLNG is re-circulated. The HLNG is re-circulated by pumping, mixing, shearing, or other means as described previously, without limitation.

The minimum light gas concentration in HLNG is predetermined. In instances, the minimum light gas concentration is determined before forming the HLNG. The minimum light gas concentration is the content that is economical for transport and storage and is evaluated with respect to the cost of forming HLNG and the volume of LNG displaced by adding the light gas to a transport or storage vessel of a fixed volume. For example, the minimum ethylene concentration is predetermined by economic, cost, demand, and equipment specifications without limitation.

The HLNG is re-circulated when the solid acetylene concentration is between about 0.1 vol % to about 60 vol %; alternatively from about 5 vol % to about 50 vol %; and in certain instances from about 30 vol % to about 50 vol %. Maximum acetylene content in the HLNG is determined by the capacity of the liquid phase to contain the solid phase as slurry. The LNG is the liquid, continuous phase and the acetylene solids comprise a particulate, dispersible phase. In instances, the volume concentration of acetylene in HLNG reaches a pre-determined value. When the acetylene volume concentration reaches or exceeds the pre-determined value, the HLNG is re-circulated. The HLNG is re-circulated by pumping, mixing, shearing, or other means as described hereinabove, without limitation.

The minimum acetylene concentration in HLNG is predetermined. In instances, the minimum acetylene concentration is determined before forming the HLNG. The minimum acetylene concentration is the content that is economical for transport and storage is evaluated with respect to the cost of forming HLNG and the volume of LNG displaced by adding the acetylene to a transport or storage vessel of a fixed volume. For example, the minimum acetylene concentration is predetermined by economic, cost, demand, and equipment specifications without limitation.

In instances, the LNG liquid phase is the continuous phase and the acetylene is the dispersible phase. The HLNG, forming slurry comprising acetylene and LNG is maintained at as a substantially homogeneous mixture. The HLNG maintains a homogenous mixture without further mechanical agitation, regardless of acetylene volume concentration. Alternatively, the volume concentration of acetylene in HLNG reaches a pre-determined concentration, wherein the HLNG is re-circulated to maintain fluidization. The HLNG is re-circulated by pumping, mixing, shearing, or other means as described previously, without limitation.

In further instances, the volume concentration of any solid light gas component in the HLNG about 0.1 vol % to about 60 vol %; alternatively from about 5 vol % to about 50 vol %; and in certain instances from about 30 vol % to about 50 vol %. In certain instances or as governed by economic factors, the volume concentration of a liquid light gas may be as high as about 95%. In further instances, the volume concentration of a light gas is limited by the properties of the HLNG. For example, the concentration of the light gas is determined by the HLNG properties and ability to maintain a substantially homogeneous mixture or slurry. Alternatively, the ability of the storage vessel 400 or mixing vessel 300 to maintain the HLNG in a cryogenic liquid state without risk of rupture, corrosion, or failure without limitation. In instances, the LNG liquid phase is the continuous phase and the light gas is the dispersible phase.

The HLNG, forming a liquid mixture or slurry comprising light gas and LNG is maintained at as a substantially homogeneous mixture. The HLNG maintains a homogenous mixture without further mechanical agitation, regardless of light gas volume concentration. Alternatively, the volume concentration of light gas in HLNG reaches a pre-determined concentration, wherein the HLNG is re-circulated to maintain a substantially homogenous mixture of liquids or fluidization of solids. The HLNG is re-circulated by pumping, mixing, shearing, or other means as described previously, without limitation. When light gas is formed into HLNG under storage or transport conditions, mixing vessel 300 or storage vessel 400 is operable for re-circulation to maintain a homogenous mixture. In alternate instances, maintaining a homogenous mixture in the HLNG may use various re-circulation paths as described previously.

Figure 2:
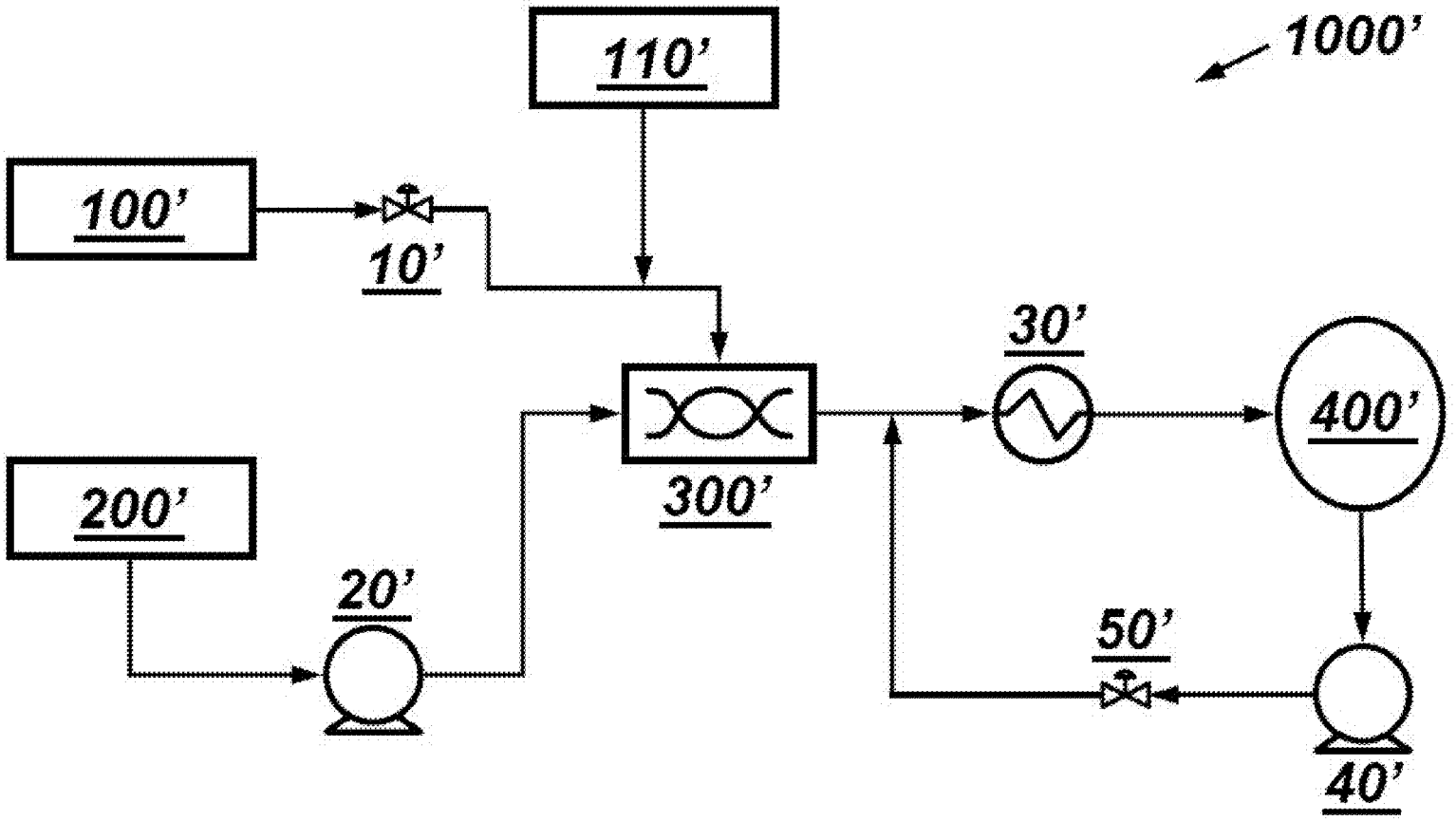
FIG. 2 is a process flow diagram illustrating another ethylene storage system, according to one embodiment of the disclosure.

Referring now to FIG. 2, ethylene storage system 1000', includes a source 100', LNG source 200', a solvent source 110', mixing vessel 300', storage vessel 400', valves 10' and 50', pumps 20' and 40', and heat exchanger 30'. Solvent source 110' is any suitable solvent source or producer. Solvents from solvent source 110' are any suitable solvent as understood by a skilled artisan, such as toluene, pentane, hexane, a toluene-benzene mixture or a cyclohexane-toluene mixture, without limitation. Solvent source 110' may also produce reactive solvents, such as metallic reactive species comprising chromium, copper (I), manganese, nickel, iron, mercury, silver, gold, platinum, palladium, rhodium, ruthenium, osmium, molybdenum, tungsten or rhenium in the form of salts or complexed species that form ligand or chemical bonds with ethylene. The solvent is sent from solvent source 110' to mixing vessel 300' to facilitate the formation of HLNG or to serve other functions, such as a surfactant, stabilizer, enhancer, or coating, without limitation. In instances, a coating maintains a solid phase, such as ethylene solids, apart from the liquid phase when the dispersible phase, such as ethylene, by itself forms a continuous or homogeneous liquid phase HLNG. Further, the HLNG may form stable or unstable slurry, without limitation; alternatively, the HLNG may form a miscible or immiscible liquid-liquid mixture. In certain instances, the concentration by volume of ethylene with solvent in the HLNG is from about 0.1 vol % to about 98 vol % , alternatively from about 5 vol % to about 95 vol %, alternatively from about 30 vol % to about 90 vol %.

Alternatively, FIG. 2 illustrates an acetylene storage system 1000' including a source 100', liquefied natural gas (LNG) source 200', acetylene solvent source 110', mixing vessel 300', storage vessel 400', valves 10' and 50', pumps 20' and 40', and heat exchanger 30'. Solvent source 110' may comprise any suitable solvent, such as dimethyl formamide, n-methyl pyrollidone, pyridine, tetrahydrofuran, or acetone. Solvent is sent from solvent source 110' to mixing vessel 300' to facilitate the formation of HLNG or to serve other functions, a surfactant, stabilizer, enhancer, or coating, without limitation. In instances, a coating maintains a solid phase, such as ethylene solids, apart from the liquid phase. In certain embodiments, the volume concentration of acetylene with solvent in the HLNG is from about 0.1 vol % to about 60 vol %, alternatively from about 3 vol % to about 45 vol %, alternatively from about 10 vol % to about 35 vol %.

Figure 3:
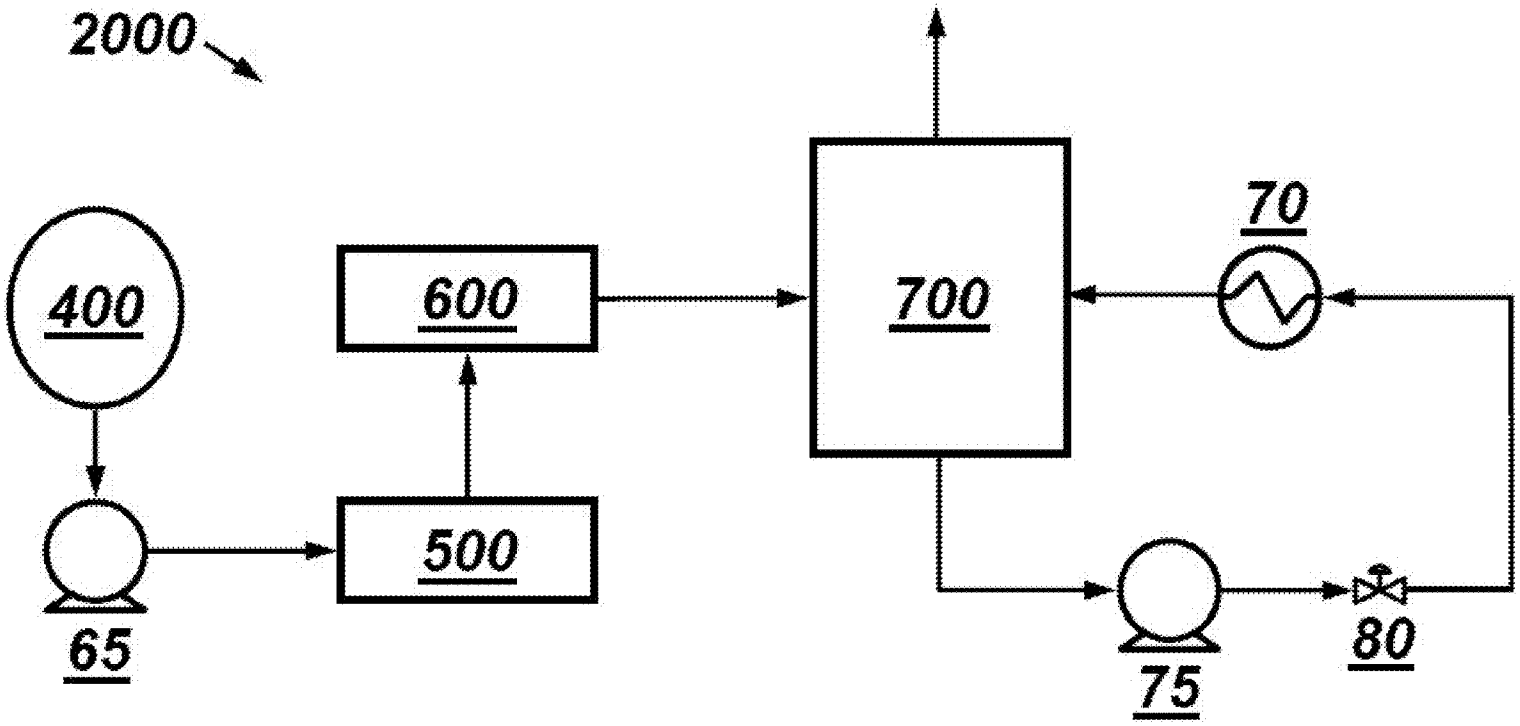
FIG. 3 is a process flow diagram illustrating an ethylene transport system, according to one embodiment of the disclosure.

Transport Referring now to FIG. 3, a transport system 2000 comprises storage vessel 400, mixture transport vehicle 500, mixture receiving vessel 600, mixture vaporization vessel 700, valve 80, pumps 65 and 75, and heat exchanger 70. The HLNG is extracted from storage vessel 400 via pump 65 and loaded into transport 500. In instances, transport 500 comprises any vessel configurable for retaining, holding, pressurizing, refrigerating, storing or maintaining HLNG for transportation. Transport 500 is configured to transport liquids or solid-liquid slurries at cryogenic conditions. In instances, transport 500 comprises a LNG vessel truck, LNG vessel ship, or pipeline without limitation. A portion of the NG may be used as fuel for the transport 500 in self-propelled instances. The HLNG transport 500 is configured as a portable storage vessel 400, and equipped with refrigeration apparatuses such as pump 40 and heat exchanger 30 as shown in FIG. 1. The transport 500 is configured to maintain HLNG during transportation in a process substantially similar to a storage vessel 400 described previously. A portion of the NG may be used to power the refrigeration means, or methods of agitation to maintain the homogeneity of the HLNG, for instance via an electrical generator. Alternatively, the process of vaporizing the LNG to NG comprises auto-refrigeration, wherein the heat of vaporization cools the surrounding gases. The transport 500 is configured to fluidly couple to storage vessel 400. The transport 500 may fluidly couple to the storage vessel at a station, dock, or other specific location with apparatuses configured to flow cryogenically maintained fluids from a storage vessel to the transport 500.

The transport 500 is offloaded, emptied, drained, or otherwise vacated of HLNG at a pre-determined destination, such as a receiving station, dock or other specific location configured to flow the HLNG from the transport 500 to a receiving vessel 600. In order to separate the HLNG, the receiving vessel 600 is fluidly coupled to a separation vessel or system 700. Without being limited by theory, the receiving vessel 600 is analogous to the storage vessel 400 previously described. In instances, the receiving vessel 600 and storage vessel 400 are operationally interchangeable, such that both vessels are configured to deliver and receive the HLNG.

The separation vessel or system 700 is configured to separate the light gas and the LNG. Without limitation by theory, separation vessel 700 is configured to separate at least a portion the light gas and LNG. In certain configurations, the storage vessel 400 or the receiving vessel 600 are operable as a separation vessel 700. Separation vessel 700 is configured for cryogenic distillation, gas phase membrane separation, filtration, gravity separation, or other techniques for active or passive separation of at least a portion of the light gas from the LNG. Thermal energy from any process is introduced into the HLNG by separation vessel 700 via heat exchanger 70. Alternatively, thermal energy may be added to the separation vessel 700 by other methods. Examples include gaseous natural gas, a component of natural gas, a noble gas, or an inert gas may be introduced into the separation vessel 700 at a temperature higher than the HLNG temperature. HLNG is circulated by pump 75 via valve 80 between the separation vessel 700 and the heat exchanger 70. Separation vessel 700 comprises any means known to one skilled in the art for separating liquids, or slurries. During separation the LNG may exist as gaseous NG, such that the separation vessel 700 is separating gases.

The separation vessel 700 may maintain or change temperature, to reach the boiling point or vaporization point of one component of the HLNG prior to the others. Further, at least a portion of one component of the HLNG will be vaporized prior to the others. For certain light gas components, such as light hydrocarbons in the HLNG, the LNG is vaporized first. Alternatively, the light gas components are vaporized first, leaving the LNG. And in still further arrangements, the separation vessel 700 vaporizes all components of the HLNG simultaneously. When the light gases and LNG are vaporized at the same time, they form a gaseous mixture, hereinafter GNG. The GNG is directed to any gas separation processes, such as but not limited to a membrane separator. Alternatively, the GNG is directed to a process for use as a mixture, for instance in gas-to-liquid (GTL) processes. Furthermore, when sufficient thermal energy is added to the HLNG, LNG and/or the light gases, the components of the HLNG may be separately vaporized into gas streams for further distribution and/or use. The release of the gases from the separation vessel 700 is controlled so that gas streams are produced at pre-determined pressure levels.

Further, steam may be introduced into the separation vessel 700. Also, a solvent liquid is added to the separation vessel 700, to remove the LNG or the liquid light gases. In yet other cases, electromagnetic energy is added to the separation vessel such as microwave, radio frequency wave, or infrared, without limitation. Furthermore, LNG may be separated from the slurries by decanting the liquid from the solid.

Without limitation by theory, the gaseous phase NG is formed from evaporated LNG. The NG may be sent to natural gas pipelines for industrial or residential use. Ethylene is evaporated from liquid or solid phase to gaseous phase. The NG passes through processing steps, such as distillation, selective absorption, membrane separation, purification, dehydration, removal of contaminants, and content adjustment in order to meet natural gas pipeline specifications.

In some cases, the vaporized light gases pass through processing steps, such as purification, separation, distillation, selective absorption, dehydration, membrane separation, filtration, gravity separation, and content adjustment in order to meet pipeline, separate transport, or chemical process specifications. Further, the light gases maybe dispersed in other liquid carriers such as a solvent as described herein to alter transportability, flammability, or other properties, without limitation.

In one instance, the ethylene gas formed by separation vessel 700 is used for various applications, such as further chemical processing, synthesizing products, such as polyethylene, ethylene oxide, dichloroethane, vinyl chloride or copolymerized with propylene, acrylic acid, methyl acrylate, vinyl acetate, acetic anhydride, malic anhydride to form polymer comonomers, without limitation. Further applications include, raw materials for the manufacture of products that include but are not limited to ethylene glycol and other glycols, ethanolamine, glycol ethers, polyols, acetic acid, acetaldehyde, chloroacetic acid, pentaerythritol, peracetic acid, polyvinyl alcohol, ethylbenzene, xylenes, fruit ripening agents, or liquid fuel synthesis. The gaseous ethylene may be implemented in any applications that are directly, indirectly, or subsequently derived from ethylene.

In another application, acetylene is evaporated from solid phase to gaseous phase. The evaporated acetylene may be used for various applications, such as welding, chemical processing to synthesize other products, such as ethylene, vinyl chloride, ethanol, ethylene oxide, acetic acid, or ethyeneamine, or for liquid fuel synthesis without limitation. The gaseous acetylene may be implemented in any applications that are directly, indirectly, or subsequently derived from acetylene.

Figure 4:
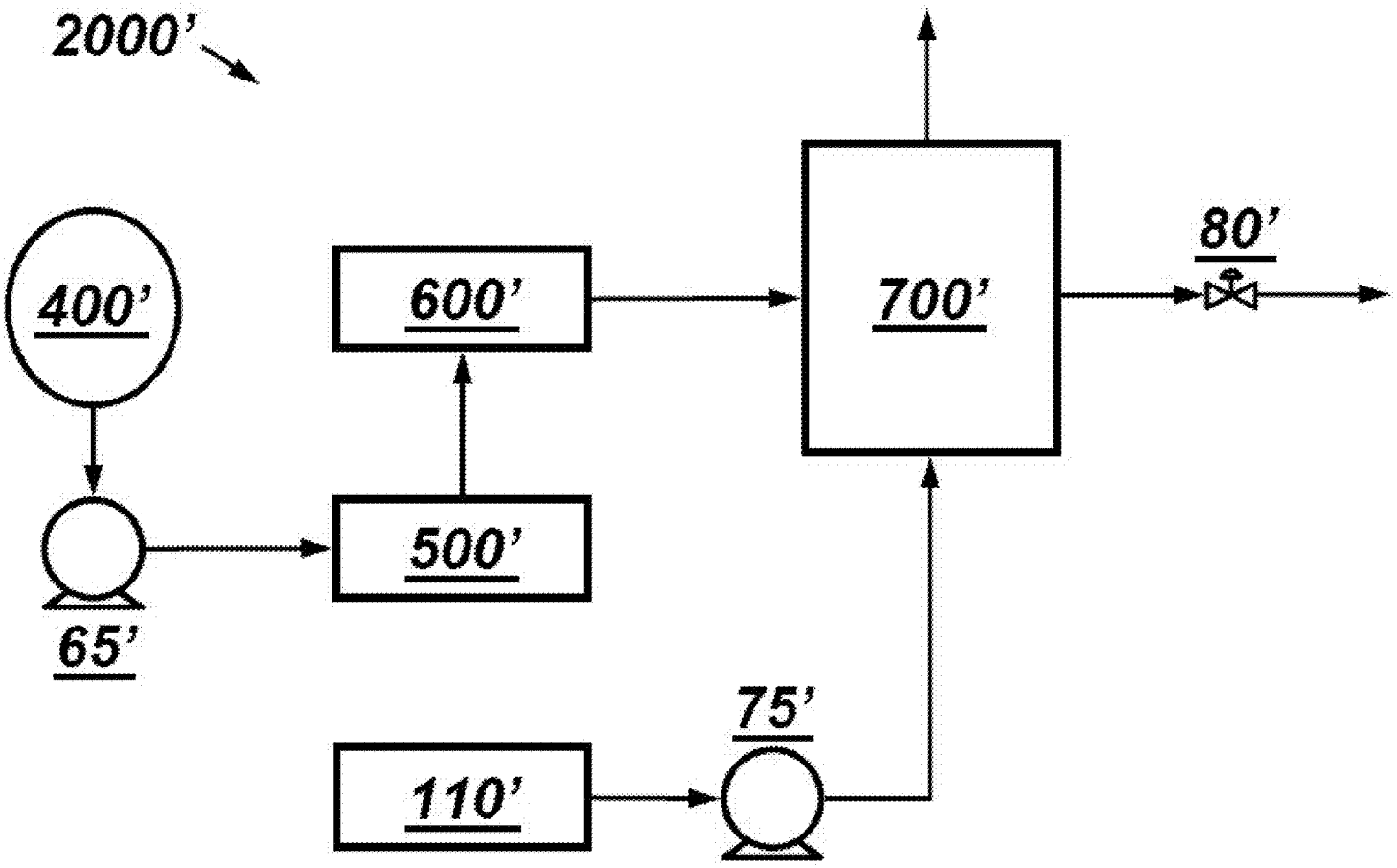
FIG. 4 is a process flow diagram illustrating another ethylene transport system, according to one embodiment of the disclosure.

Referring now to FIG. 4, illustrating a storage system 2000' comprises storage vessel 400', transport 500', receiving vessel 600', separation vessel 700', valve 80', pumps 65'and 75', and solvent source 110'. Solvent source 110' may comprise any suitable ethylene solvent, such as toluene, pentane, hexane, a toluene-benzene mixture or a cyclohexane-toluene mixture. The solvent source 110' may also provide reactive solvents, such as metallic reactive species comprising chromium, copper (I), manganese, nickel, iron, mercury, silver, gold, platinum, palladium, rhodium, ruthenium, osmium, molybdenum, tungsten or rhenium in the form of salts or complexed species that form ligand or chemical bonds with ethylene. The solvent is pumped from solvent source 110' to separation vessel 700' via pump 75' to increase the thermal energy of the mixture so that natural gas is evaporated from the mixture and ethylene is dissolved in the solvent to form an ethylene solution. The ethylene solution is extracted from separation vessel 700' via valve 80'. In some cases, the ethylene solution leaving valve 80' is ready for handling, storage, and distribution.

Alternatively, referring to FIG. 4, solvent source 110' may comprise any suitable acetylene solvent, such as dimethyl formamide, n-methyl pyrollidone, pyridine, tetrahydrofuran, or acetone. The solvent is pumped from solvent source 110' to separation vessel 700' via pump 75' to increase the thermal energy of the slurry so that natural gas is vaporized and acetylene is dissolved in the acetylene solvent to form an acetylene solution. The acetylene solution is extracted from slurry vaporization vessel 700' via valve 80'. In some cases, the composition of the acetylene solution is safe for handling, storage, and distribution.

Further, the ethylene or acetylene is directed to additional downstream processes. The ethylene, acetylene, or other gases may require further treatment, filtration, separation or adjustment to meet quality specifications which may involve processing by common techniques including: distillation, selective absorption, membrane separation, dehydration and filtration. An ethylene or acetylene absorbent may be used as the solvent, to facilitate selective absorption to separate ethylene or acetylene from natural gas. As such, the ethylene and acetylene separation from the LNG or NG is conducted by selective absorption.

Operation The method and system of storing and transporting ethylene may be expanded to any chemical compound that is a solid or liquid at the conditions of LNG, −161° C. at one atmospheric pressure, and becomes a separable liquid or gas under the conditions where LNG is a vapor, especially at ambient conditions, such as 300 to 330 K at one atmospheric pressure. In instances, the current process is effective for transporting any gas known at STP and with a freezing or boiling point between about 0° C. and −160° C. For dangerous chemicals, such a method and system may also be used for safer handling, storage, and transport. Table 1 summarizes some of the chemicals that are suitable for the disclosed method and system wherein the state of the chemical is at the boiling point of methane at atmospheric pressure.

In operation, the light gas storage/transport system as disclosed herein may be located near or adjacent to a facility in which natural gas is treated and cooled to cryogenic conditions. In instances, the proximity provides natural gas liquefied at near ambient pressure conditions. Further, the light gases may be transported from a first location to a second location wherein the light gases have higher market value, according to the present disclosure. For example, at the first location, there is little or no facility for chemical processing of propylene or for utilization of natural gas; whereas, at the second location, there is a great need for propylene and/or natural gas.

Furthermore, the present disclosure allows for the operation of equipment at the generating or receiving site when powered by either a portion of the vaporized gases, any combustible or flammable residues, byproducts, impure streams or solvents used or generated as a part of the process.

TABLE 1

| COMPOUND | BOILING POINT (K) | FREEZING POINT (K) | STATE |
|---|---|---|---|
| Methane | 111.7 | 90.7 | L |
| Hydrogen sulfide | 212.8 | 186.7 | S |
| Ammonia | 239.7 | 195.4 | S |
| Trifluorobromoethane | 214 | — | — |
| Chlorotrifluoromethane | 191.7 | 92 | L |
| Phosgene | 280.8 | 145 | S |
| Carbonyl sulfide | 222.9 | 134.3 | L |
| Chlorodifluoromethane | 232.4 | 113 | S |
| Dichloromonoflurormethane | 282 | 138 | S |
| Perfluoroethene | 197.5 | 130.7 | S |
| Xenon | 165 | 161 | S |
| Krypton | 119.8 | 115.8 | S |
| Cyanogen | 252.3 | 245.3 | — |
| Propylene | 225.4 | 87.9 | L |
| Methyl ethyl ether | 280.5 | 134 | S |

To further illustrate the various feature of the present disclosure, the following examples are provided:

EXAMPLES

During storage or transport of the mixture of natural gas and ethylene or acetylene, the volume of the solid-liquid system can be heated to boiling point or vaporization point. In cases where the gas evolved is not returned to the container by refrigeration, the gas may be vented. The following is common to all the examples: an insulated container that was placed inside a plastic enclosure was filled with liquid nitrogen in order to form a liquid nitrogen bath that could be isolated from the environment. A glass tube of dimensions 1 inch in diameter and 18 inches in length capable of being sealed and pressurized was purged with nitrogen from a pure nitrogen cylinder and placed in the nitrogen purged container inside the nitrogen purged enclosure. Although moisture should not affect the test, normal precautions were done to ensure it was not introduced to the tube. Once the glass tube that was placed into the nitrogen bath had come to thermal equilibrium with the liquid nitrogen, the test substance was introduced into the glass cylinder by running it through a ⅛" (0.125 in) steel tube to a location near the bottom of the glass tube, although not touching it. The test substance was introduced slowly so that the sample gas initially formed a cloud near the bottom of the glass tube then liquefied or solidified according to its boiling and melting points. After approximately 10 to 20 grams of solidified gas were collected, the sample gas flow was stopped and the sample gas introduction tube was removed from the glass tube. Next, methane was introduced to the glass tube by a similar ⅛" (0.125 in) stainless steel tube. The methane liquefied and added to the total liquid volume. Enough methane was introduced into the tube so that it nearly filled the tube, and in certain instances covered the solid. The glass tube was then removed from the liquid nitrogen bath, inserted into a sleeve of insulation, sealed, and made part of a gas sampling system for a gas chromatograph. The sealing mechanism contained a thermocouple that allowed the temperature of the liquid to be measured. A ⅛" (0.125 in) stainless steel tube was affixed to the sealing mechanism for the glass tube and run through a 5 psi back pressure valve. The backpressure valve prevented incursion of external gas into the sample tube while heat from the environment entered the tube and caused the mixture to boil and generate pressure. Five psi was also enough to ensure the gas flowing to the gas chromatograph had sufficient pressure to enter and flow through the gas chromatograph sampling mechanism and give accurate and reliable results. The cryogenic solid/liquid mixture or was allowed to slowly boil off at 5 psi in the insulated sleeve while a gas chromatograph calibrated for several gas compounds including those contained in the tube collected data continuously at regular intervals. Each test was continued until the temperature of the material in the tube was well above the boiling temperature of any individual compound tested.

Figure 5:
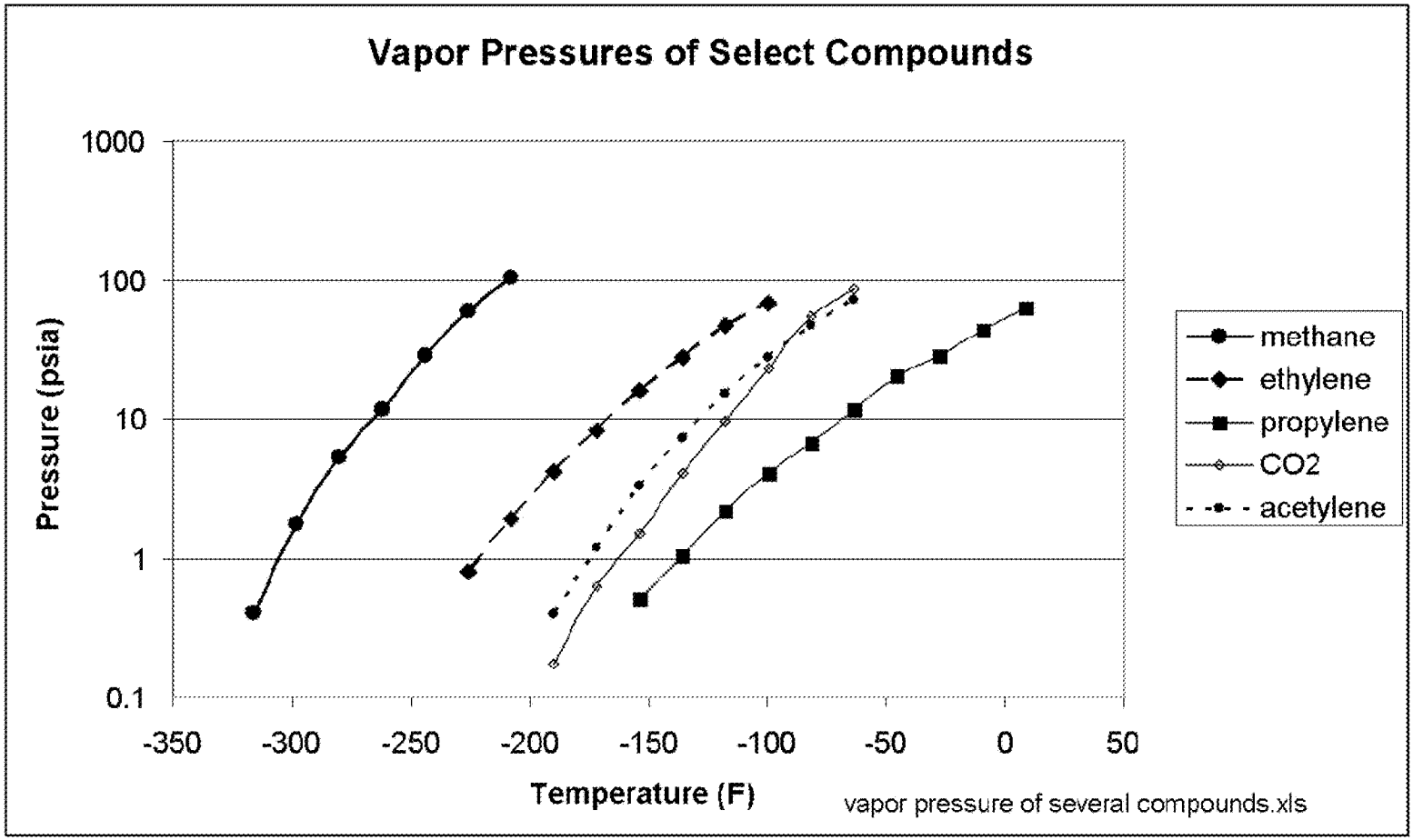
FIG. 5 illustrates the vapor pressures versus temperature curve of selected compounds, according to one embodiment of the disclosure.
Figure 6:
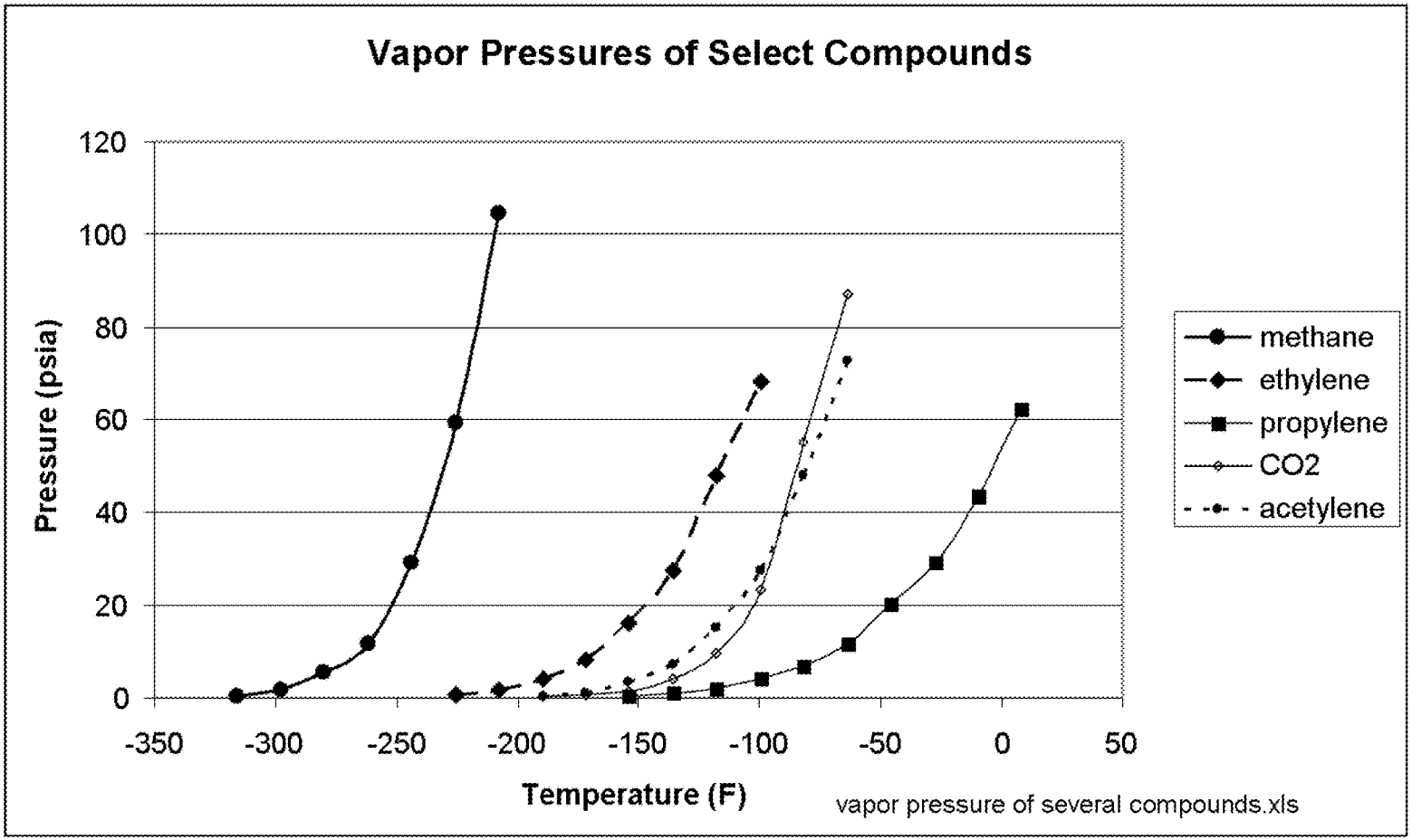
FIG. 6 illustrates an alternate vapor pressure versus temperature curve of selected compounds, according to one embodiment of the disclosure.
Figure 7:
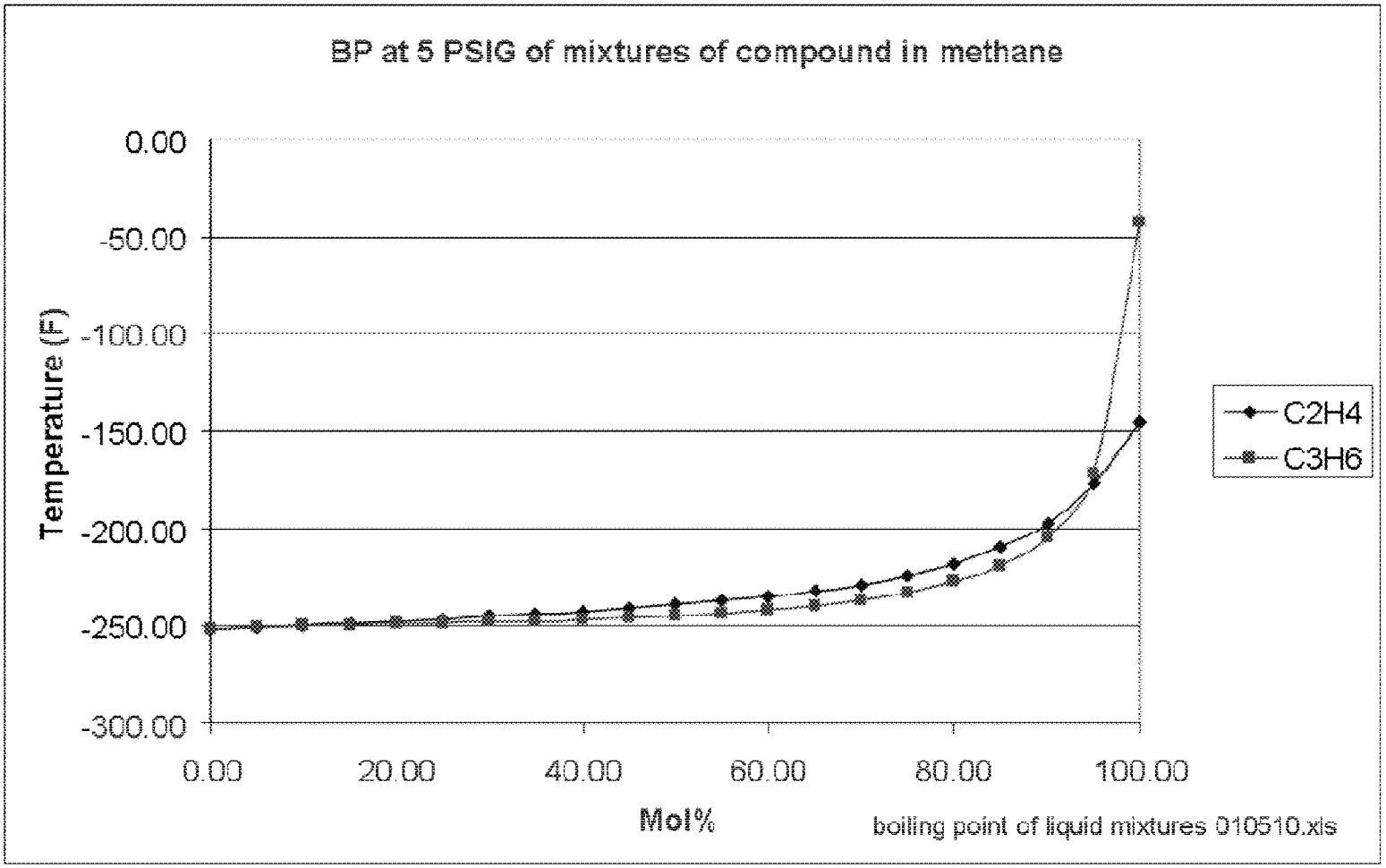
FIG. 7 illustrates the boiling point of mixtures in methane, according to one embodiment of the disclosure.
Figure 8:
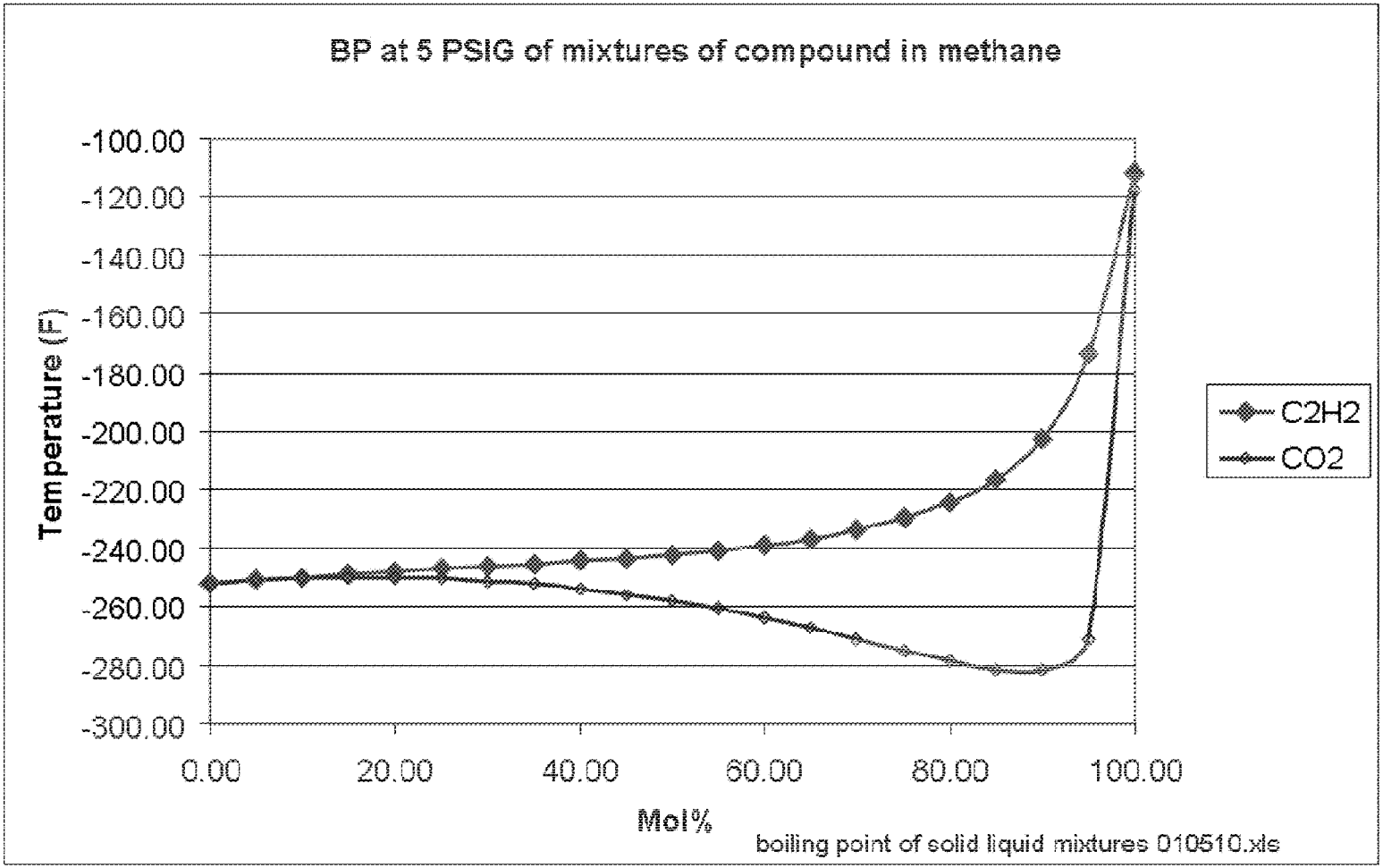
FIG. 8 illustrates the boiling point of addition mixtures in methane, according to one embodiment of the disclosure.

That temperature of the boiling mixture will depend upon the composition of the liquid system or the solid-liquid system and the pressure of containment. The component with higher volatility will tend to predominate in the vapor phase. Solid components generally have very low vapor pressure. FIGS. 5 and 6 illustrate the vapor pressure of select compounds as a function of temperature. FIG. 7 shows the boiling temperature of methane-ethylene and methane-carbon dioxide mixtures as a function of composition at 5 psig. FIG. 8 shows the boiling temperature of methane-acetylene and methane-carbon dioxide mixtures as a function of composition at 5 psig. From these graphs, it is possible to determine the composition of these binary mixtures from their boiling point.

Figure 9:
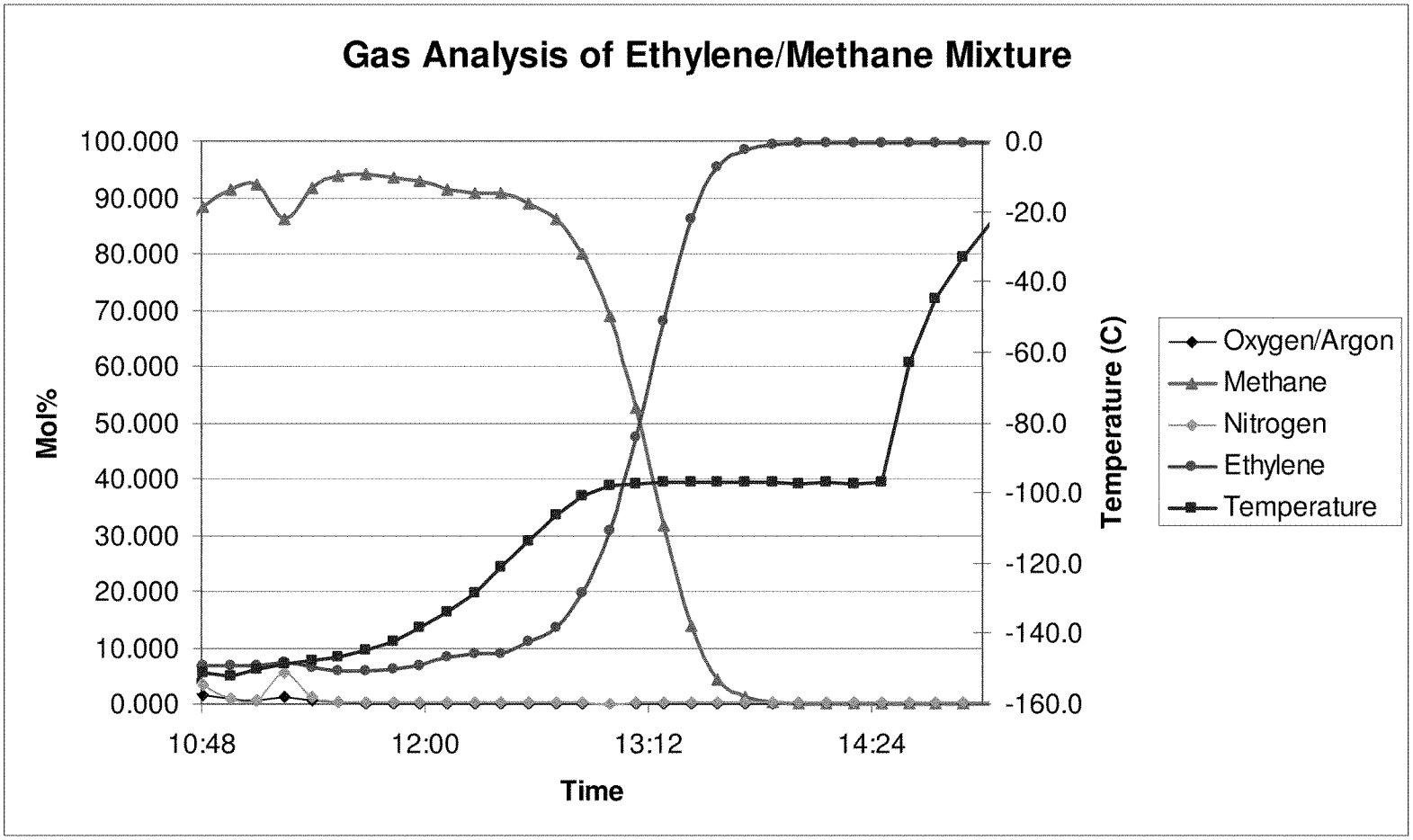
FIG. 9 illustrates a mole percent and temperature gas analysis by time of an ethylene-methane mixture, according to one embodiment of the disclosure.

FIG. 9 illustrates the behavior of a mixture of predominantly methane and ethylene as the mixture warms and volatilizes at a constant pressure of 5 psig as depicted in FIGS. 5 and 6. Initially, the gas composition evolved is predominantly methane at about 92 mol %, with 7 mol % ethylene and 1 mol % minor components. The minor components of nitrogen, about 0.3 mol %, and Argon, about 0.02 mol %, were introduced into the system during sample preparation as part of the purge gas. As the liquid vaporized, with a significant excess of methane present, the temperature remained constant around −155C. When most of the methane had left the system, the liquid temperature increased from −110° C. to −97° C. When the methane content dropped to less than 1%, the ethylene remained liquid and the temperature stabilized at −97° C. When the ethylene vaporized, the system temperature increased rapidly.

Figure 10:
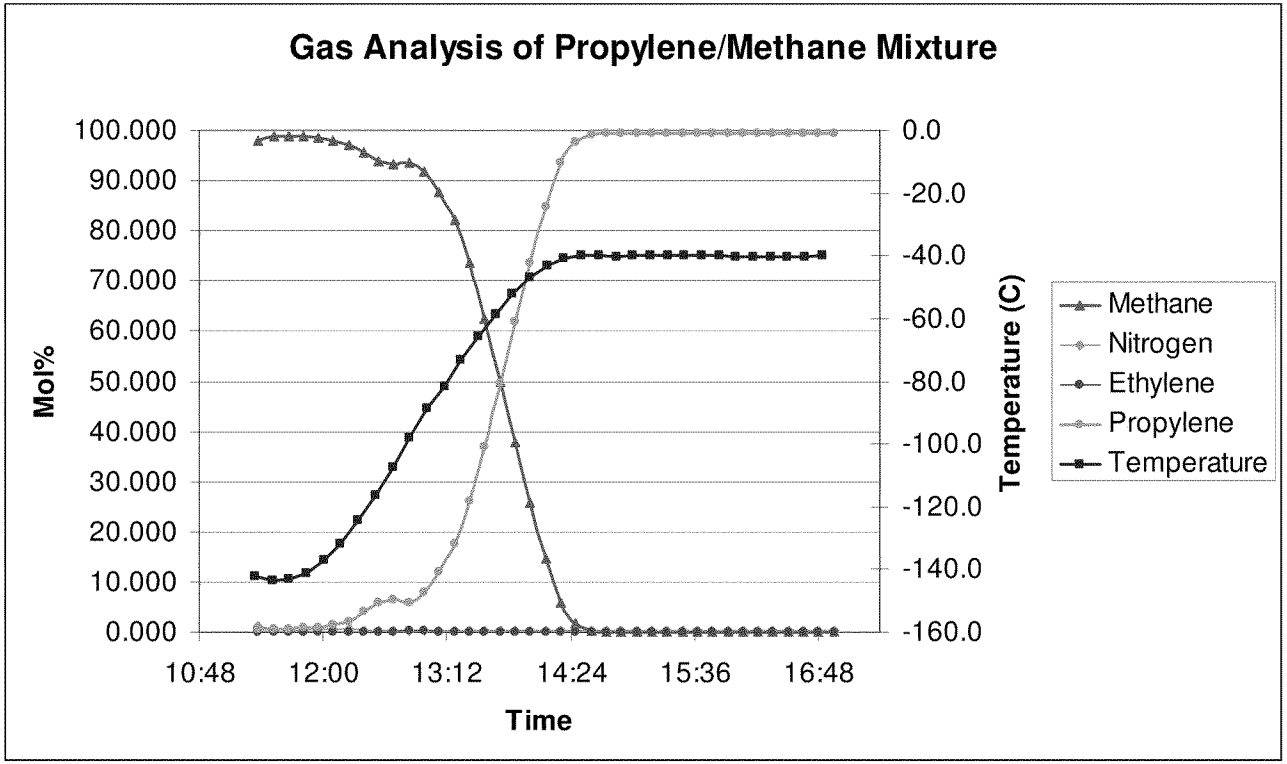
FIG. 10 illustrates a mole percent and temperature gas analysis by time of an propylene-methane mixture, according to one embodiment of the disclosure.

FIG. 10 shows the behavior of a liquid mixture of predominantly methane and propylene as the mixture warms and volatilizes at a constant pressure of 5 psig, as depicted in FIGS. 5 and 6. Initially, the gas composition evolved is predominantly methane at about 98 mol %, with 1.0 mol % ethylene, 1.0 mol % nitrogen and 0.00 mol % propylene. The nitrogen was introduced into the system during sample preparation as part of the purge gas. The ethylene was a minor component of the propylene. As the liquid vaporized, with a significant excess of methane present, the temperature remained constant around −140° C. When most of the methane had left the system, the liquid temperature increased from −140° C. to about −40° C. The liquid temperature increased from about −90° C. to −40° C. during the period where the gas composition of methane dropped from about 90 mol % to about 0.5 mol % and the propylene content increased from about 10 mol % to 99.5 mol %.

The graphs in FIGS. 9 and 10 illustrate that for mixtures rich in the more volatile component, in this case methane, the lower volatility liquid at that temperature remains a minor component in the vapor phase until most of the more volatile component mass has vaporized.

Figure 11:
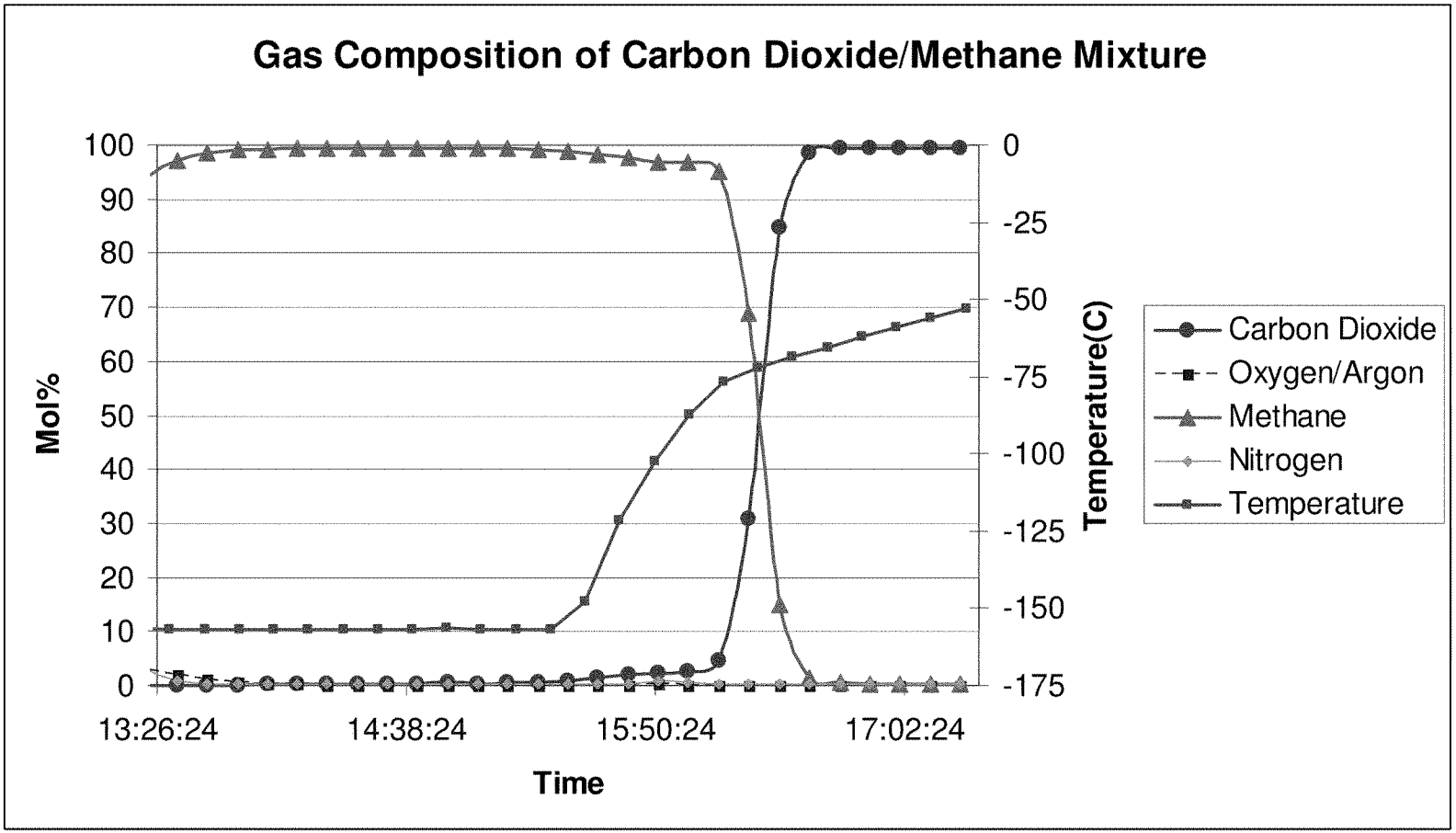
FIG. 11 illustrates a mole percent and temperature gas analysis by time of an carbon dioxide-methane mixture, according to one embodiment of the disclosure.

FIG. 11 shows the behavior of a mixture of predominantly methane and carbon dioxide as the mixture warms and volatilizes at a constant pressure of 5 psig. Initially, the gas composition evolved is predominantly methane at about 98.5 mol %, with less than 1.0 mol % carbon dioxide. The final composition was about 99.75 mol % $CO_2$ and 0.06% methane, with the balance being nitrogen.

Figure 12:
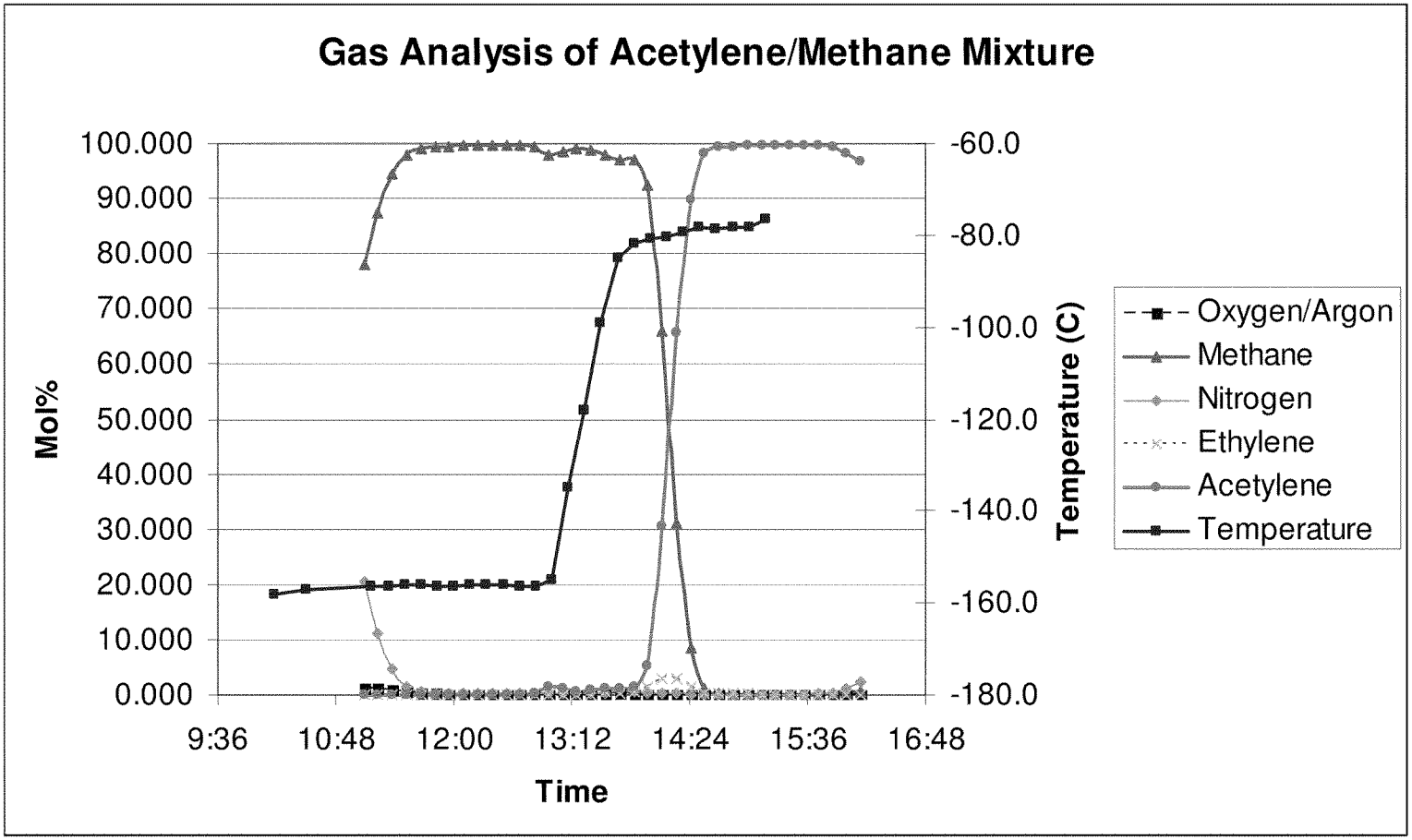
FIG. 12 illustrates a mole percent and temperature gas analysis by time of an acetylene-methane mixture, according to one embodiment of the disclosure.

FIG. 12 shows the behavior of a mixture of predominantly methane and acetylene as the mixture warms and volatilizes at a constant pressure of 5 psig. Initially, the gas composition evolved is predominantly methane at about 99.4 mol %, with 0.3 mol % acetylene and 0.3 mol % minor components. The minor components of nitrogen, about 0.2 mol %, and ethylene, about 0.1 mol %, were introduced into the system during sample preparation as part of the purge gas or as a component of the acetylene. As the liquid vaporized, with a significant excess of methane present, the temperature remained constant around −155° C. When most of the methane had left the system, the temperature rapidly increased from −155° C. to about −85° C. When the liquid actually vaporized, as shown by the temperature increase, there was significant methane in the vapor space of the test device, so the steepest portions of change of composition and temperature do not lie upon one another, but the rate of methane composition change is similar to the rate of temperature change for this mixture.

These examples show that for mixtures rich in the more volatile component, in this case methane, the normally solid compound at that temperature remains a minor to undetectable component in the vapor phase until most of the more volatile liquid component mass has vaporized.

What is claimed is:

1. A method for transporting gases, consisting essentially of:

mixing a first gas stream, in the gas phase, with a liquid natural gas stream to form a mixture having a concentration of the first gas stream from about 30 vol % to about 95 vol %;

reducing the temperature at ambient pressure of the mixture to below the vaporization point of the first gas stream to liquefy the mixture into a liquefied mixture; and transporting the liquefied mixture in a fixed volume vessel.

2. The method of claim 1, wherein the first gas stream comprises at least one gas selected from the group consisting of ethylene, acetylene, propylene, noble gases, hydrogen sulfide, ammonia, phosgene, methyl-ethyl ether, trifluorobromoethane, chlorotrifluoromethane, chlorodifluoromethane, dichloromonoflurormethane, carbon dioxide, carbon monoxide, butene, dibutene, vinyl acetylene, butane, propane, ethane, methyl acetylene, water, hydrogen, gases at STP, and combinations thereof.

3. The method of claim 1, wherein mixing the first gas stream with the liquid natural gas stream further comprises:

collecting a vaporized gas from at least one of the first gas stream, the natural gas stream, and the liquefied mixture; and condensing the vaporized gas for return to the liquefied mixture.

4. The method of claim 1, wherein reducing the temperature of the mixture to below the vaporization point of the first gas stream further comprises liquefying the first gas stream to form a liquid-liquid mixture or solidifying the first gas stream to form a slurry or solidifying a solvated first gas stream to form a slurry.

5. The method of claim 1, wherein transporting the liquefied mixture comprises:

storing the liquefied mixture in a thermally regulated first vessel at a first location;

agitating the liquefied mixture within the first vessel to maintain a substantially homogeneous mixture;

conveying a portion of the liquefied mixture from the first vessel to a second vessel; and transporting the second vessel to a second location.

6. The method of claim 5, wherein storing the liquefied mixture in the thermally regulated first vessel further comprises maintaining the liquefied mixture at a temperature below the vaporization temperature of the first gas stream by at least one process selected from the group consisting of auto-refrigeration, refrigerating the liquefied mixture, exposing the liquefied mixture to a heat exchanger, and combinations thereof.

7. The method of claim 5, wherein agitating or transporting the liquefied mixture further comprises removing a portion of the liquefied mixture for at least one process selected from the group consisting of: fueling a refrigeration system, fueling a transport vehicle, and combinations thereof.

8. The method of claim 5, wherein conveying at least a portion of the liquefied mixture from the first vessel to the second vessel further comprises loading a transport vessel capable of transporting the liquefied mixture by land or water.

9. The method of claim 5, further comprising:

conveying a portion of the liquefied mixture in the second vessel to a third vessel at the second location;

vaporizing a portion of the liquefied mixture; and separating a portion of the first gas stream from the liquid natural gas steam for downstream processes.

10. The method of claim 9, wherein vaporizing a portion of the liquefied mixture further comprises adding thermal energy by at least one process selected from the group consisting of: electromagnetic radiation, introducing gases to the third vessel, directing a portion of the liquefied mixture through a heat exchanger, and combinations thereof.

11. The method of claim 9, wherein vaporizing a portion of the liquefied mixture further comprises introducing gases to the third vessel, and wherein introducing gases to the third vessel further comprises introducing one selected from the group consisting of: gaseous natural gas, components of natural gas, noble gas, inert gas, and combinations thereof.

12. The method of claim 9, wherein vaporizing a portion of the liquefied mixture comprises at least one process selected from the group consisting of separating a portion of the first gas stream and the liquid natural gas stream, vaporizing a portion of the first gas stream before the liquid natural gas stream, vaporizing a portion of the liquid natural gas stream before vaporizing the first gas stream, and combinations thereof.

13. The method of claim 9, wherein separating the first gas stream from the liquid natural gas stream further comprises at least one selected from the group consisting of cryogenic distillation, gas phase membrane separation, filtration, gravity separation methods, decantation, solvent absorptions, and combinations thereof.

14. The method of claim 1, wherein the mixing occurs at pressures up to 5 pounds per square inch (psig).

15. A method for transporting gases, comprising:

mixing a first gas stream, in the gas phase, with a liquid natural gas stream to form a mixture, wherein the first gas stream is selected from the group consisting of ethylene, ethane, acetylene, propylene, and combinations thereof; and wherein the mixture has a concentration of ethylene from about 30 vol % to about 98 vol %;

reducing the temperature at ambient pressure of the mixture to below the vaporization point of the first gas stream to liquefy the mixture into a liquefied mixture;

storing the liquefied mixture in a thermally regulated first vessel at a first location;

maintaining the liquefied mixture at a temperature at ambient pressure below the vaporization temperature of the first gas stream by auto-refrigeration comprising vaporizing liquid natural gas from the liquefied mixture; and transporting the liquefied mixture in a fixed volume vessel at ambient pressure.

* * * * *